US008950311B2

(12) United States Patent
Emde et al.

(10) Patent No.: US 8,950,311 B2
(45) Date of Patent: Feb. 10, 2015

(54) HANDGUN

(71) Applicants: Dietmar Emde, Arnsberg (DE); Michael Swoboda, Möhnesee (DE)

(72) Inventors: Dietmar Emde, Arnsberg (DE); Michael Swoboda, Möhnesee (DE)

(73) Assignee: German Sport Guns GmbH, Ense-Höingen (DE)

( * ) Notice: Subject to any disclaimer, the term of this patent is extended or adjusted under 35 U.S.C. 154(b) by 0 days.

(21) Appl. No.: 14/017,331

(22) Filed: Sep. 4, 2013

(65) Prior Publication Data

US 2014/0165441 A1 Jun. 19, 2014

(30) Foreign Application Priority Data

Sep. 4, 2012 (DE) ..... 10 2012 108 208

(51) Int. Cl.

| | |
|---|---|
| ***F41F 1/08*** | (2006.01) |
| ***F41C 3/00*** | (2006.01) |
| ***F41A 19/18*** | (2006.01) |
| ***F41A 19/21*** | (2006.01) |
| ***F41A 19/54*** | (2006.01) |

(52) U.S. Cl.

CPC ... *F41C 3/00* (2013.01); *F41F 1/08* (2013.01); *F41A 19/18* (2013.01); *F41A 19/21* (2013.01); *F41A 19/54* (2013.01)

USPC ..... 89/127; 89/1.41

(58) Field of Classification Search

None

See application file for complete search history.

(56) References Cited

U.S. PATENT DOCUMENTS 1,902,702 A * 3/1933 Jenkins ..... 42/42.01
2,092,850 A * 9/1937 Neubrand ..... 42/42.02

FOREIGN PATENT DOCUMENTS

DE 31 23 603 * 5/1982

* cited by examiner

*Primary Examiner* — Stephen M Johnson
(74) *Attorney, Agent, or Firm* — Michael Soderman

(57) ABSTRACT

This invention relates to a handgun comprising a weapon frame with a grip and a break-barrel unit (11) that can be tilted forward and that is comprised of at least two barrels. A firearm as per the invention provides for a bifunctional or multifunctional hammer unit, comprising at least two hammers (19) that can be moved independently of one another when the firearm is triggered; each hammer impacts only one firing pin (28) in each case of a firing-pin unit (27) comprising at least two firing pins (28, 29) in separated positions, wherein each firing pin is assigned to one barrel of the firearm in each case. A double-barrel or multi-barrel firearm is provided in a compact design in which the hammer unit is cocked with a relatively high amount of spring force with a relatively small amount of existing space. In addition, this invention provides a firearm that has less trigger weight.

14 Claims, 13 Drawing Sheets

HANDGUN

CROSS REFERENCE TO RELATED APPLICATIONS

This application claims the benefit of German Application No. 102012108208.1 filed on Sep. 4, 2012; this application is incorporated by reference herein in its entirety.

BACKGROUND OF THE INVENTION

This invention relates to a handgun comprising a weapon frame with a grip and a break-barrel unit that can be tilted forward and that is comprised of at least two barrels.

Pistols with a break barrel that can be tilted forward are known in the prior art. As an example, reference is made to the model Piper M 1909 Steyr pistol. An air pistol with a break barrel is described in the German patent specification DE 574 329, for instance. Handy, compact pistols with a relatively small design and a break-barrel unit with two barrels are likewise known (model Derringer), for instance from the documents DE 199 40 998 B4 or DE 83 11 185.9 U1.

SUMMARY OF THE INVENTION

This invention relates to a handgun comprising a weapon frame with a grip and a break-barrel unit (11) that can be tilted forward and that is comprised of at least two barrels. A firearm as per the invention provides for a bifunctional or multifunctional hammer unit, comprising at least two hammers (19) that can be moved independently of one another when the firearm is triggered; each hammer impacts only one firing pin (28) in each case of a firing-pin unit (27) comprising at least two firing pins (28, 29) in separated positions, wherein each firing pin is assigned to one barrel of the firearm in each case. A double-barrel or multi-barrel firearm is provided in a compact design in which the hammer unit is cocked with a relatively high amount of spring force with a relatively small amount of existing space. In addition, this invention provides a firearm that has less trigger weight.

DETAILED DESCRIPTION

The task of this invention is to provide a handgun of the type mentioned at the outset that has a reduced trigger weight.

A handgun of the type mentioned at the outset with the features of claim 1 solves this problem.

Accordingly, the invention envisages a bifunctional or multifunctional hammer unit, comprising at least two hammers that can be moved independently of one another when the firearm is triggered; each hammer acts upon only one firing pin in each case of a firing-pin unit comprising at least two firing pins in separated positions, wherein each firing pin is assigned to one barrel of the firearm in each case.

The bifunctional hammer unit is preferably designed so as to be able to swivel around an axis, and the at least two hammers jointly swivel into their cocked position during the cocking process.

It is especially advantageous when, in accordance with a further design form of the invention, the cocking process of the hammer unit is brought about by means of a component that is attached in a swiveling fashion to the break-barrel unit and that acts upon the hammer unit when the break-barrel unit is closed. This component could be a movable cocking lever plate, in particular.

The force that is otherwise required for the cocking of the hammer unit is applied via the closing of the break barrel in a firearm in accordance with the invention. Only the force required for triggering has to be applied to the trigger when shooting because of that, so a reduced trigger weight results.

A further design form of the problem solution in accordance with the invention envisages that a movable cocking lever plate presses in an initial movement phase during the cocking of the hammer unit against a projecting element, especially a cam, a shaped piece or the like of the hammer unit and swivels it into the cocked position, and the cocking lever plate moves below the projecting element via a downwards swiveling movement when the cocked position is reached and consequently releases the hammer unit.

A preferred further design form of the invention envisages that a first firing-pin unit of the firearm can be replaced with an alternative, second firing-pin unit with approximately the same dimensions in which the firing pins are in different positions. This makes it possible, for instance, to optionally use different ammunition for the same firearm, i.e. ammunition of a different caliber or even different types of ammunition. As an example, certain firing pins can be used for edge-firing cartridges and other firing pins can be used for cartridges that are impacted in the center.

The most diverse types of ammunition are a possibility for a firearm as per the invention. The term firearm in the sense of this invention embraces firearms that can be carried on the body of the user, that can be used with one or two hands by a person and that make it possible to send out a projectile load comprised of at least one projectile type selected from the group made up of projectile gases, projectile liquids, projectile particles, solid-powder projectiles and homogeneous solid projectiles in a deliberate way for at least a short distance of a few meters in a targeted, limited area.

A preferred further design form of the invention envisages that the hammer unit interacts with at least one cocking status indicator that is partially visible on the outside of the firearm and acts on it in such a way in the cocked position that it is moved into a position in which it indicates the cocked status of the firearm. If the firearm has two barrels, for example, there will preferably be two cocking status indicators of that type, so one can see whether the respective hammer is cocked for each barrel. At least one cocking status indicator is preferably attached in a swiveling fashion above or behind the hammer unit, and it is swiveled into an upper position when the hammer is cocked.

In particular, in accordance with a further design form of this invention, the hammer unit can have a shaped piece that is radial with regard to its swivel axis and that acts on a movable component carried in a recess of the housing when the hammer unit swivels; the component is moved against the effects of a spring force when the hammer unit is swiveled into its cocked position. It is possible in this way to apply a high level of cocking force to the hammer in the cocked position with a simultaneous housing of the components used for this in a small space. The above-mentioned movable component is acted upon by the spring force in the process and redirects this force through the radial shaped piece to the hammer. This movable component could be a bolt, for instance, that is acted upon at one end of the shaped piece of the hammer unit and that acts at the other end on a compression spring, which is compressed in the cocked position (of the hammer).

A further preferred design form of the invention provides for an indicator window on the side of the housing of the firearm, preferably in the area of the grip piece, that indicates the hammer that will next be actuated when the trigger is pulled via a change in color or via a cam that can be moved out.

To secure the hammer or hammers in the cocked position, there are preferably provisions for the hammer unit to have a locking element by means of which the hammer unit is blocked in the cocked position by a sear interacting with the locking element.

The invention envisages that the firearm has a break barrel that can be tilted forward and that the tilting mechanism is triggered by means of a lever or slide located in the top rear area of the frame of the firearm that can also simultaneously serve as a sight. The invention advantageously provides for the hammers to be cocked via the closing of the break barrel, so the trigger weight will be reduced to a considerable extent, because only the relatively small amount of force that is still required for triggering has to be applied when the trigger is pulled.

A further design form of the invention provides for a trigger unit including the trigger on the firearm that has an element that selectively acts on a rocker assigned to one of the hammers; the rocker selectively triggers one of the hammers in each case. In particular, this can be designed in such a way that the trigger unit comprises a control-wheel unit with at least one control wheel that has at least two cams in different peripheral positions; the cams alternately interact with one rocker each in each case when the trigger is pulled several successive times and alternately trigger a hammer assigned to a barrel of the firearm in each case. A design solution of this type ensures, on the one hand, that the other hammer will be triggered when the trigger is pulled once again after one of the hammers has been triggered. In addition, the above-mentioned control-wheel unit can be used to provide an indication on the firearm as to which of the barrels will be fired next, for instance by providing a control wheel with different colored areas so that the corresponding colored areas can be displayed in an indicator window on the housing depending on the position of the control wheel. After the trigger has been pulled and the firearm has been fired, the control wheel rotates by one angular unit so that the colored area changes in the indicator window. In the case of a firearm with two barrels, two different colored areas that alternate on the surface of the control wheel will suffice.

The subclaims relate to preferred further design forms of the problem solution in accordance with the invention. Further advantages of the invention ensue from the following description of the examples that make reference to the enclosed drawings.

DESCRIPTION OF THE DRAWINGS

The following are shown here:

FIG. 15 shows a view of the trigger unit from the top in which the longitudinal sections in accordance with FIGS. 11 and 12 are drawn in;

DETAILED DESCRIPTION OF THE PREFERRED EMBODIMENTS

Figure 1:
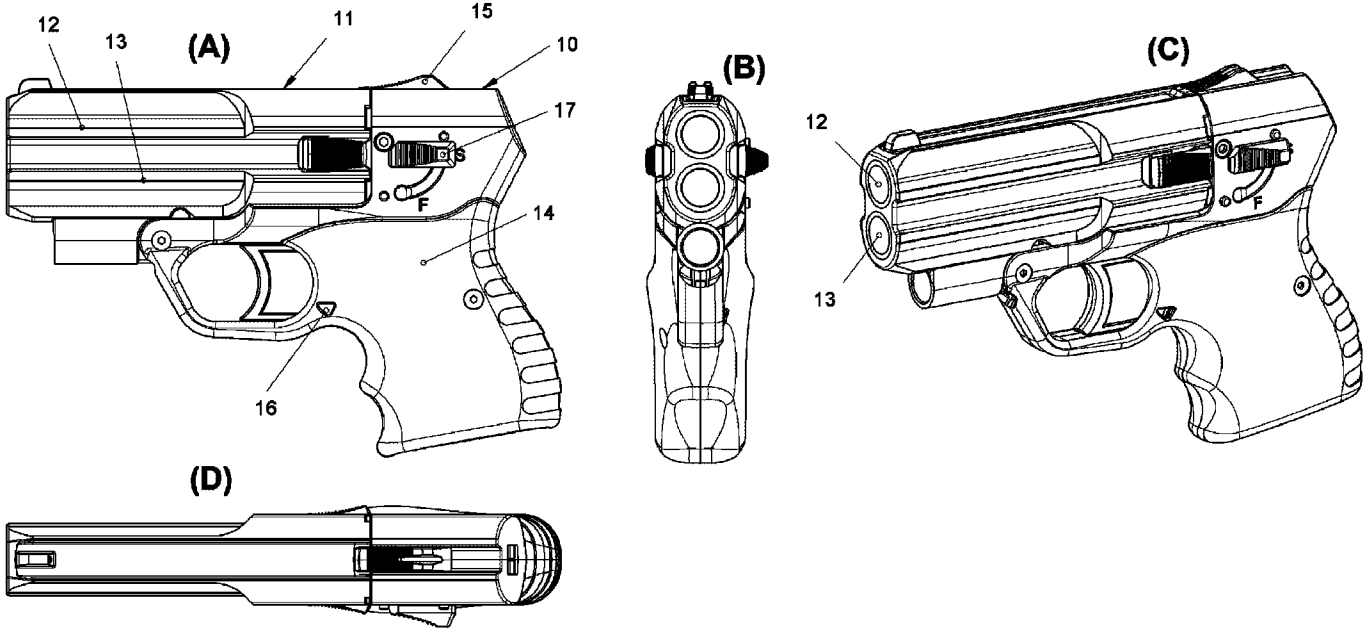
FIG. 1A shows a side view of an exemplified firearm in accordance with the invention.
FIG. 1B shows a front view of an exemplified firearm in accordance with the invention.
FIG. 1C shows a view of the firearm in perspective.
FIG. 1D shows a top view of the firearm.

Reference is made at first to FIG. 1. The handgun shown here is a pistol 10 with a grip piece 14 and with a break-barrel unit 11 that has two barrels 12, 13 and that can be swiveled around an axis, so the entire break-barrel unit 11 can be tilted forwards. The tilting of the barrel unit 11 is possible after a slider 15 is pushed back and the barrel unit has thereby been released. The slider can be designed in such a way that it simultaneously also serves as a sight. An indicator window 16 in which information about the firearm can be read or felt as to which hammer will be the next one to be triggered when the trigger is pulled is located on the grip piece 14 of the firearm. A swiveling safety lever 17 that is in the locked position in FIG. 1 is provided on the housing of the firearm above the grip piece 14.

Figure 2:
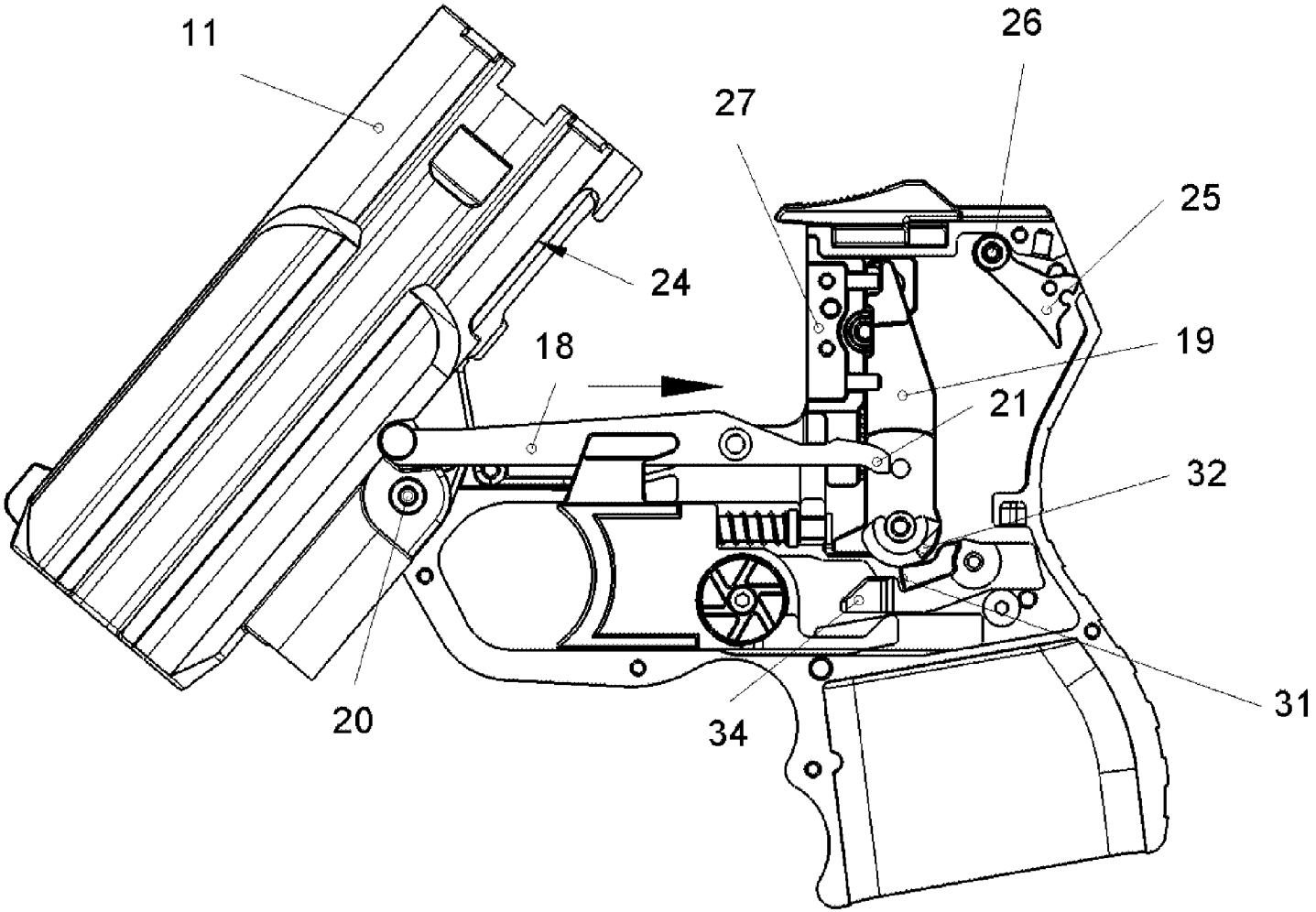
FIG. 2 shows a side view with a tilted-down barrel and a view into the interior of the firearm.

Further details of the firearm as per the invention will be explained below with reference to FIGS. 2 and 3. Detailed drawings are involved, as well as views that show the interior of the firearm with various positions of the break barrel. FIG. 2 shows the firearm with a tilted barrel unit 11; the cocking lever plate 18 and one of the hammers 19 can be recognized in the side view. One sees that the break-barrel unit 11 is swiveled forward around the swivel axis 20; the cocking lever plate 18 is attached in a swiveling fashion to the break-barrel unit 11. Now when the break-barrel unit 11 is put back into its closed starting position from this tilted position of the barrel, this leads to the cocking lever plate 18 being moved backwards in the direction of the arrow. The rear end 21 of the cocking lever plate 18 turned away from the break-barrel unit 11 presses against a cam 22 attached to the hammer 19 in the process, which leads to this hammer 19 swiveling around its axis to the rear into a cocked position. The second hammer of the hammer unit is carried along in the process and, as a result, it also swivels around its axis to the rear into a cocked position.

Figure 3:
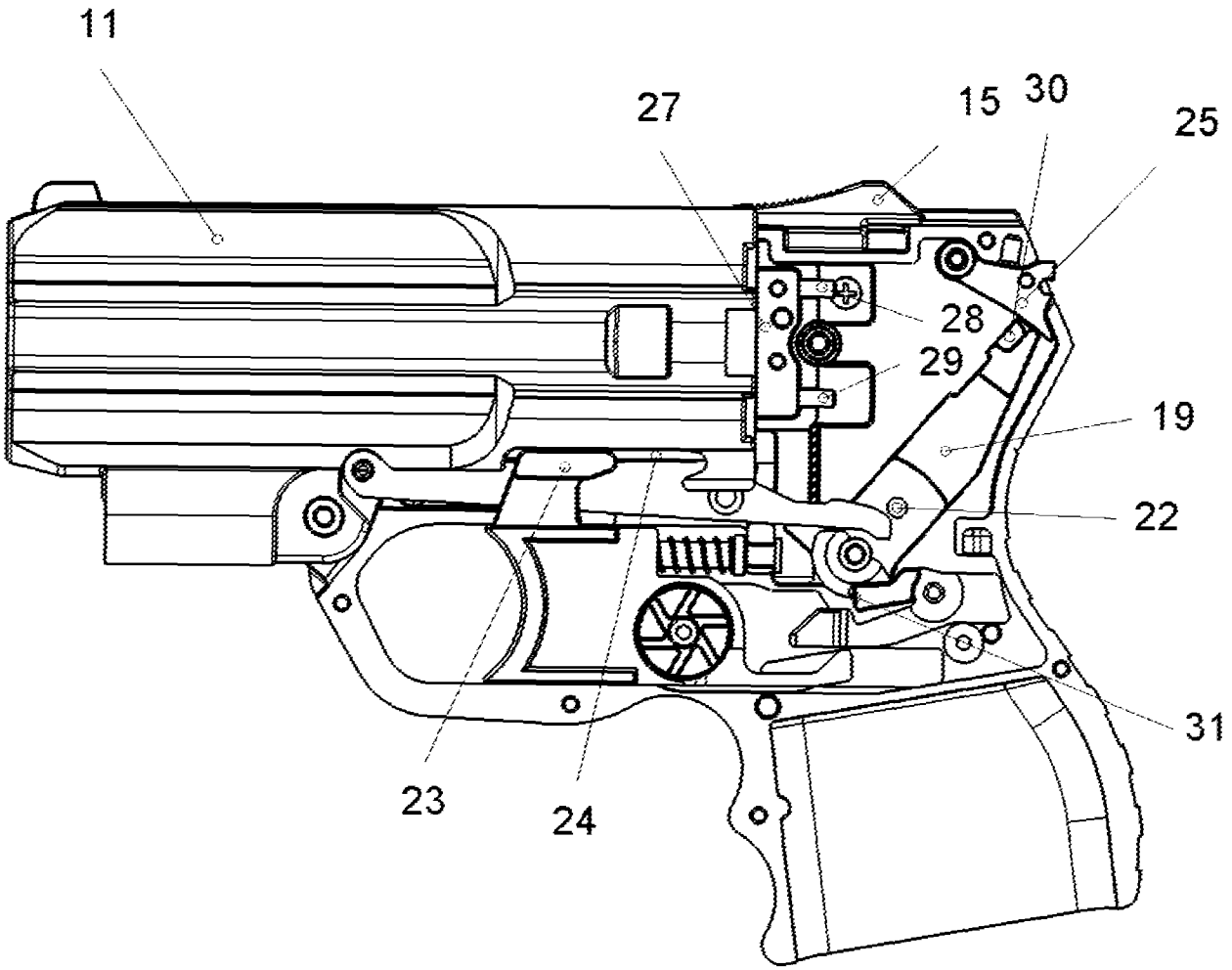
FIG. 3 shows a side view similar to that of FIG. 2, but with a closed break-barrel unit.

FIG. 3 shows the position in which the break-barrel unit 11 is closed again in a partially sectioned side view similar to the one shown in FIG. 2. One sees in FIG. 3 that the cocking lever plate 18, connected in a swiveling fashion to the break-barrel unit, is now in an end position in which it moves under the cam 22 on the hammer 19 and thereby releases the hammer. This results because the cocking lever plate 18 is finally pressed downwards when the break-barrel unit 11 is closed, and the cam 22 on the hammer 19 is released in the end position because of that. The hammer then falls into its sear 31 and is kept in it cocked position because of that.

This sear 31 that can be seen in FIGS. 2 and 3 serves to latch the hammer 19 into the cocked position, and it is roughly located in an area directly below the lower end of the hammer 19. The hammer 19 has a radial reduction at the periphery close to its swivel axis, which results in a projection 32 on the hammer that interacts with the above-mentioned sear 31 and, as is seen in FIG. 3, catches and latches the hammer in the cocked position of the hammer 19; the front end of the sear 31 latches behind the projection 32 of the hammer 19 and swivels upwards in the process, as is seen with a comparison of the respective positions of the sear 31 in FIGS. 2 and 3.

Furthermore, one of the two cocking status indicators 25 can be seen in FIGS. 2 and 3 that interacts with the hammer 19 in each case; the uncocked condition is shown in FIG. 2 and the cocked position is shown in FIG. 3 in which the upper end of the hammer 19 engages below the cocking status indicator 25 and pushes it upwards, causing the cocking status indicator to swivel around an axle 26. Depending on the position of the cocking status indicator 25, one of which exists for each hammer of the firearm and thus two in this example, a person can consequently see and feel from the outside on the rear of the firearm whether the corresponding hammer is cocked for the projectile of this barrel, because the cocking status indicators can be seen and felt at the rear of the weapon.

Moreover, the firearm as per the invention has a modular firing-pin element 27; the two firing pins 28, 29 are located at its rear, spaced vertically apart from one another. The individual hammer 19 is naturally only permitted to act on one of the two firing pins when the firearm is triggered, which is solved in the example in such a way that the upper area of the hammer 19 has a striking surface 30 formed by a recess that hits the upper of the two firing pins 28 when the hammer 19 is triggered, whereas the lower of the two firing pins labeled 29 is in front of the hammer 18, viewed in a perpendicular sense to the plane of the drawing, and is consequently not acted upon by it. This can be easily seen in the fired position in accordance with FIG. 2. The hammer 19 shown in FIGS. 2 and 3 is the right-hand (rear, in the view in accordance with FIG. 2) hammer and it only acts on the upper firing pin 28, but not on the lower firing pin 29, for which a second (left-hand) hammer is provided that is not shown in FIG. 2. Both of the hammers together form the bifunctional hammer unit of the firearm.

Figure 4:
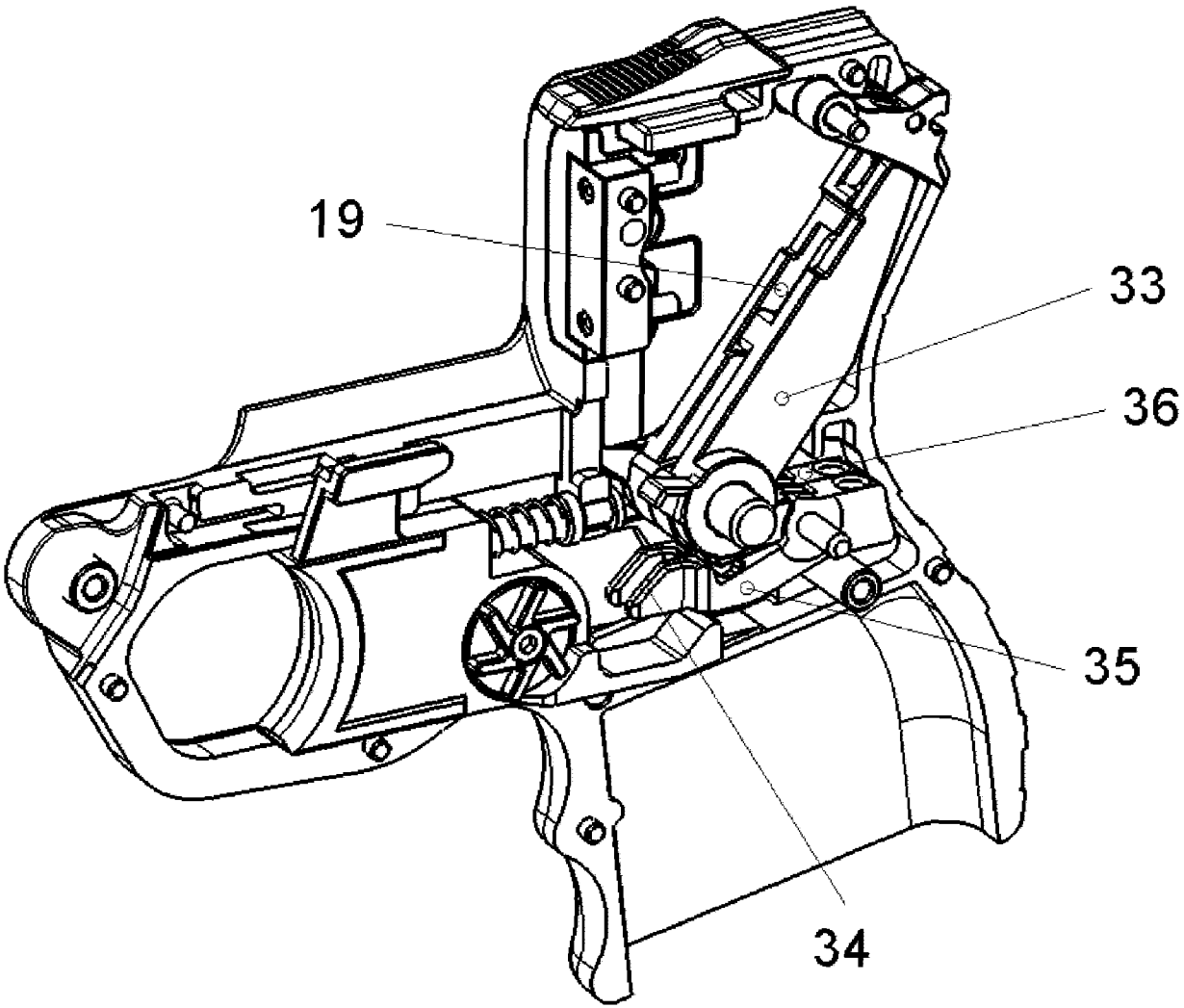
FIG. 4 shows a view in perspective of a portion of the partially disassembled firearm in accordance with an example of this invention.

Further details of the mechanics of the firearm follow from the presentation in accordance with FIG. 4. One sees the bifunctional hammer unit that comprises, in addition to the front hammer 19 that has already been described, a second hammer 33 in the rear in the drawing that does not have the same design as the hammer 19, as seen. Both of the hammers 19, 33 engage with one another, viewed in the crosswise direction of the firearm. Both of the hammers 19, 33 are in the rear, cocked position in the position in accordance with FIG. 4. If the firearm is fired, only one of the hammers moves into the front trigger position and acts on the corresponding firing pin, so the other respective hammer remains in the rear position and consequently cocked. The hammers 19, 33 each have radial shaped pieces 34 in the area of their swivel axes, one of which can be seen in FIG. 4 and also in FIG. 2. This radial shaped piece of the other rear hammer 33 cannot be seen in FIG. 4, because it has a position that is offset with regard to the periphery to that of the shaped piece 34 of the front hammer 19. The above-mentioned shaped pieces 34 are there to create the spring force during the cocking of the hammers that is required to abruptly move the hammer forward at a high speed when the firearm is fired.

The spring mechanism acting when the hammer is cocked becomes clearer with the aid of the FIGS. 5, 6 and 7, to which reference is made below. A pin 47, 48 arranged in a roughly vertical fashion in a guide in the firearm in each case is provided for each hammer 19, 33; the pin in the uncocked position of the hammer is roughly parallel to the hammer, but it forms an acute angle to the hammer in the cocked position in accordance with FIG. 6. A radial shaped piece 34 is located close to the swivel axis 49 in each case in the lower area of each hammer 19, 33; the shaped piece moves upwards out of the uncocked position in accordance with FIG. 5 when the hammer rotates around its swivel axis 49 (see FIG. 6), which causes the coil springs 50, 51, which are designed to be compression springs, which are placed around the pins 47, 48 and which are held in a recess, for instance the grip panel, to be pressed together and therefore cocked.

Figure 6:
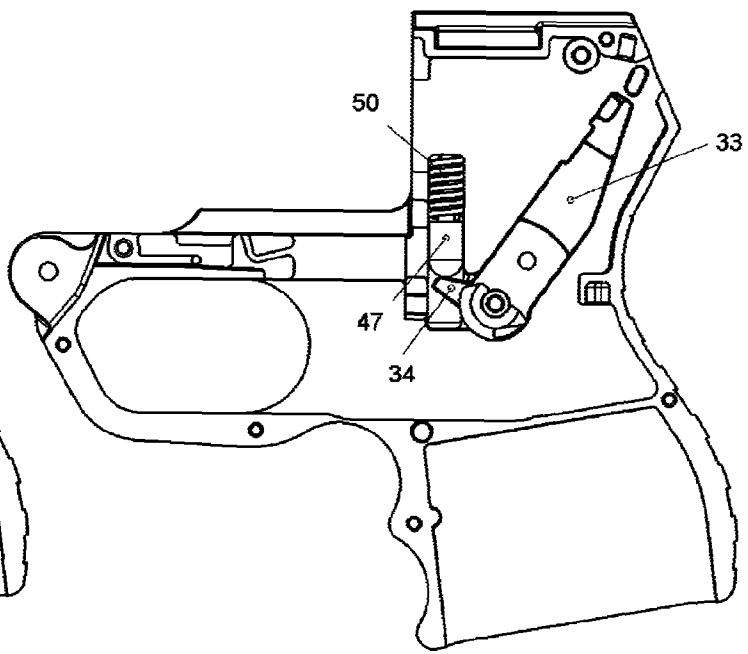
FIG. 6 shows a side view corresponding to that of FIG. 5, but the cocking lever is in the rear, cocked position.

Because of this design solution, a spring mechanism is able to be created in a relatively small amount of space that exerts a high level of spring force on the hammer 19, 33 in its cocked position in accordance with FIG. 6, so the hammer 19, 33 shoots forward at a high speed and hits the firing pin 28 when the firearm is triggered (also see FIG. 2). Whereas only the rear hammer 33 with its spring mechanism is shown in each case in the side views in accordance with FIGS. 5 and 6, both of the hammers 19, 33 can be seen with their respective pins and springs in FIG. 7.

The structure of the triggering mechanism of a firearm in accordance with the invention will first be explained in more detail below with reference to FIGS. 8 to 15. The triggering system comprises the trigger unit 37 with the trigger 38, which is customarily pulled with a finger when the firearm is fired and which is moved towards the rear end of the firearm (opposite the direction in which the shot is fired). Two control wheels 39, 40 that each have cams 41, 42 arranged on their circumference at regular intervals along the periphery, the function of which will be explained later in more detail, are arranged one behind the other in the housing of the trigger unit so as to be able to rotate in their axial direction (axis in the crosswise direction of the firearm). On its side turned towards the outside of the firearm, the first control wheel 39 has alternating colored areas on the periphery in each case between ribs of a conveyance contour 52 that serve to make the hammer of the firearm that is cocked in each case visible via an indicator window 16 that can be seen from the outside of the firearm (see FIG. 1).

Figure 10:
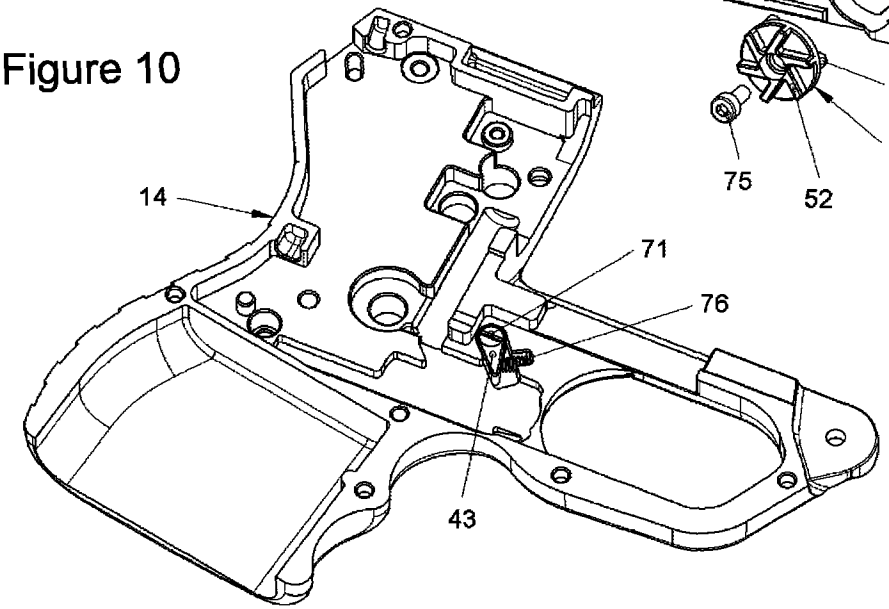
FIG. 10 shows a view in perspective of the left-hand grip panel of a firearm in accordance with the invention, viewed from the interior.
Figure 12:
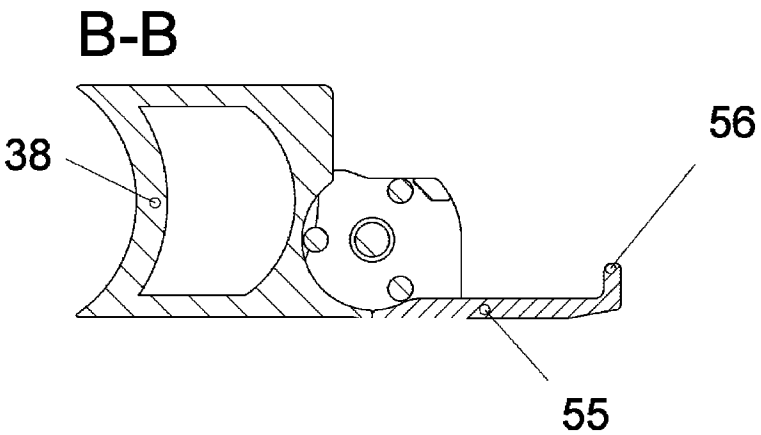
FIG. 12 shows a further longitudinal section through the trigger unit.
Figure 11:
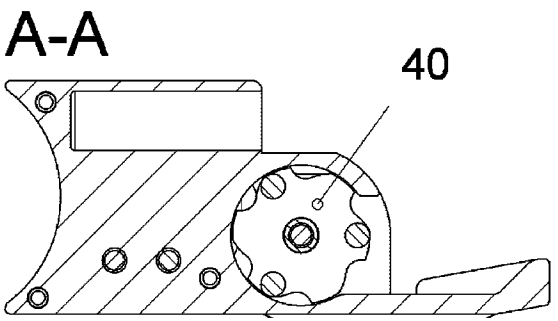
FIG. 11 shows a longitudinal section through the trigger unit.
Figure 15:
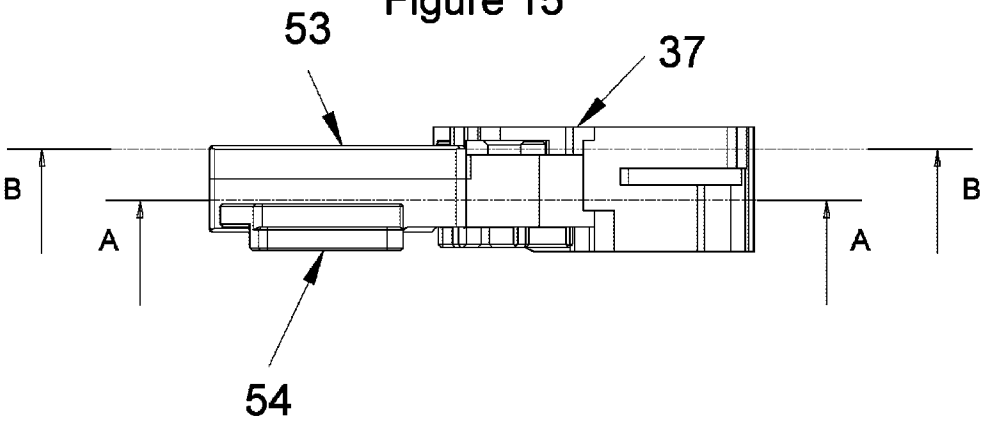
Figure 14:
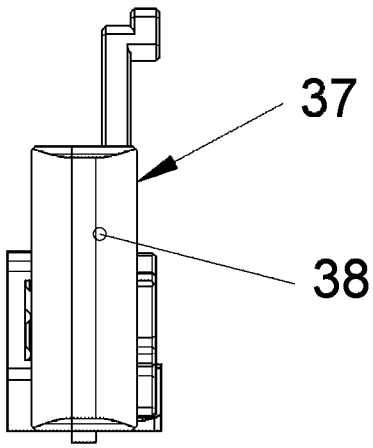
FIG. 14 shows a view of the trigger unit from the front.
Figure 13:
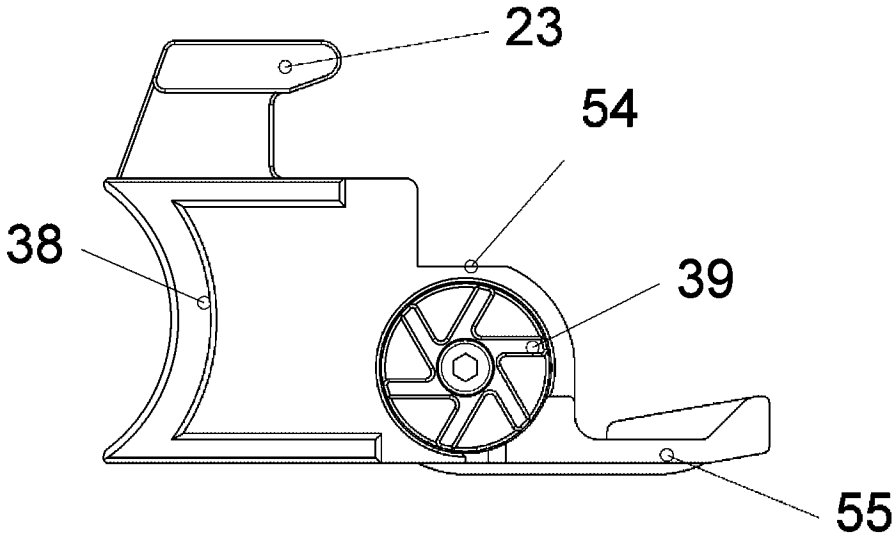
FIG. 13 shows a side view of the trigger unit.

A spring-mounted conveyance lever 43 that acts as a transfer switch and that is mounted in the left-hand grip panel of the grip pieces 14 of the firearm, as can be seen in FIG. 10, interacts with the two control wheels 39, 40. The conveyance lever 43 is fastened with the screw 71 in the housing of the firearm so as to be capable of swiveling around an axis. This conveyance lever is acted upon by the conveyance contour 52 (projecting ribs or the like) of the control wheel 39, which rotates the connected control wheel 39/40 forward in a defined manner when the trigger 37 is pulled.

Figure 9:
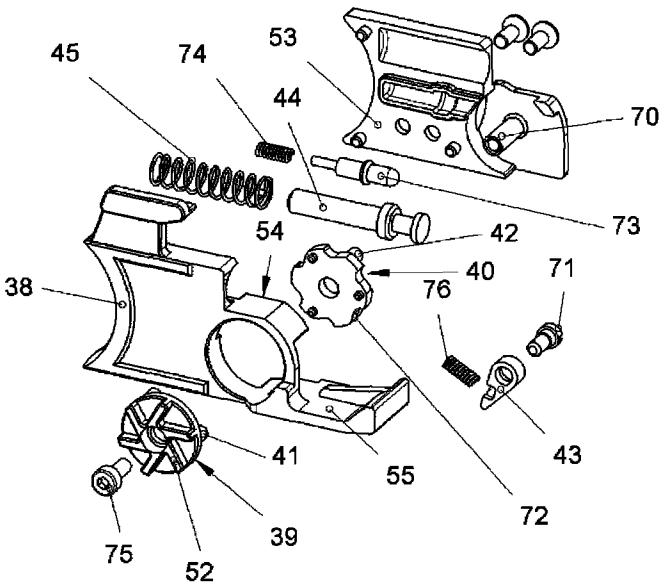
FIG. 9 shows an exploded view of the trigger unit shown in FIG. 8.
Figure 8:
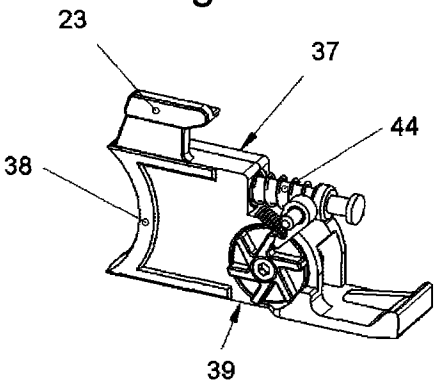
FIG. 8 shows a detailed view in perspective of a portion of the triggering system of a firearm in accordance with the invention.

The trigger unit 37 additionally comprises, as is seen in FIG. 9, two shell-like halves 53, 54 that together form a housing (see FIG. 8) in which the connected control wheels 39, 40 are mounted on an axle 70 so as to be able to rotate and in which a stud 44 aligned in parallel with the direction of the shot is mounted. The stud is the bearing for a coil spring 45 that surrounds it and that serves to build up a restoring force in the direction of the shot when the trigger 38 is pulled; this ensures that the trigger will move back into its starting position again after the firearm is fired. The stud 44 is held in the housing of the firearm (also see FIGS. 2 and 4) and is mounted in shaped pieces of the two halves of the trigger unit 37; the rear half of the housing of the trigger unit 37 has the reference numeral 53 in FIG. 9, and the shaped piece for the stud 44 can be seen there. The spring 45 is compressed and therefore generates the restoring force for the trigger 38 when the trigger unit 37 is moved relative to the stud 44 because the stud 44 is held in place in the housing of the weapon.

The right-hand control wheel 40, which is connected to the left-hand control wheel 39 through the axle 70 and the screw 75, has a latching contour 72 on its outer rim that can only be rotated in one direction in connection with the catch bolt 73 that is spring-mounted via the spring 74 in the housing of the trigger unit 37.

The front half 54 of the housing of the trigger unit 37, which can be seen in FIG. 9, has an oblong projection 55 behind the area in which the two control wheels 39, 40 are mounted that extends to its rear end area; its task is to interact in each case with one of the two rockers 35, 36, shown in FIG. 4, when the trigger is pulled. This function will be explained in more detail later on when the functions of the triggering mechanism are described. Reference is also made to the individual drawings in accordance with FIGS. 11 to 15 for the further design details of the trigger unit 37. How the front control wheel 39 is mounted in the half part 54 can be seen in FIG. 13, where as the rear control wheel 40 can be seen in the sectional view in accordance with FIG. 11. An angled part 56 that is directed upwards is located at the rear end of the oblong projection 55; its function is to engage under the rockers 35, 36, causing the cocked hammer to be finally released from its latch in an end phase when the trigger 38 is pulled. This can best be explained with the aid of the schematic diagrams in accordance with FIGS. 16 to 19, which show the various movement phases when the trigger is pulled; reference is made to them below.

Figure 16:
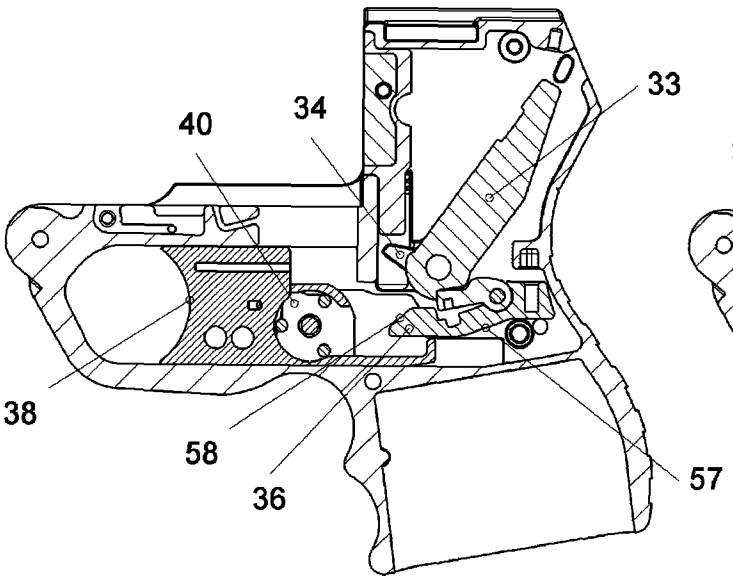
FIG. 16 shows a schematically simplified side view to explain the functions of the triggering system in an initial movement phase, wherein the view is into the right-hand grip panel of the grip piece.

The trigger 38 is in the starting position in FIG. 16; the hammer that is shown here among the two hammers 19 is in its rear, cocked position. The oblong projection 55 of the trigger unit with the angled part 56 engages under one of the two rockers 36 so that it is pressed upwards, causing the sear 31 to engage behind the projection 32 of the hammer 19 and thereby latch it into its rear, cocked position. The control wheel 40, which has staggered cams 42 on its circumference, is in a starting position.

Figure 17:
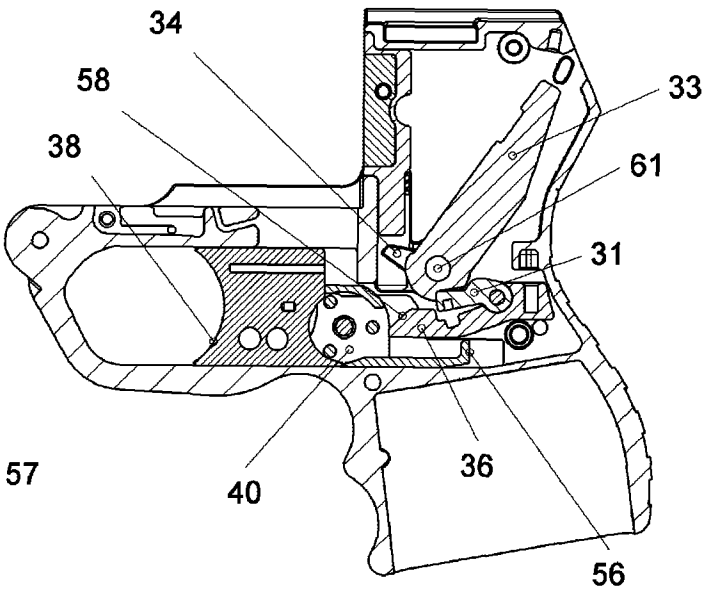
FIG. 17 shows a further schematically simplified side view to explain the functions of the triggering system in a second movement phase.

The trigger 38 is now pulled part of the way backwards from the starting position according to FIG. 16 into the intermediate position in accordance with FIG. 17; the trigger moves past the transfer switch 43 (conveyance lever) that is spring-mounted in the grip piece. In the process, the control wheel 40 that acts as a ratchet rotates counterclockwise 60°, for instance, and latches in its next position. The rotation of the control wheel 40 can be easily recognized when comparing FIG. 17 with FIG. 16. The angled part 56 is still located under the rocker 36. But the latter has a tilted area 57 at the bottom of its rear portion that acts like a ramp. In addition, the rocker 36 also has a ramp 58 at the top of its rear area. Now when the trigger 38 is moved further back by the remaining path, this leads, on the one hand, to one of the cams 42 moving to the area of a ramp 58 (oblique) at the front end of the rocker 36 and pushing it down. Moreover, the angled part 56 of the trigger unit now moves into the area of the ramp 57 and the rocker 36 is thereby released and can now swivel downwards. Because of that, the sear 31 now likewise moves down in a swiveling motion, which is why it no longer blocks the projection 32 of the hammer 19 and which is why it is therefore released and abruptly moves forward in a swiveling motion around its axis 61 to hit the firing pin (the latter is not shown here) and initiate a shot in that way.

Since the mechanism that is equivalent to a ratchet is comprised of two control wheels 39, 40 that each have cams 41, 42 (see FIG. 9) offset vis-a-vis one another by 60°, for instance (⅙ of a complete revolution), only one cam comes onto the ramp 58 at the front end of a rocker 36 and triggers it, whereas the other rocker 35 (also see FIG. 4, where the two rockers are shown) is not touched by the next cam in the peripheral position and therefore remains in its position. If, as an example, the right, rear hammer 33 (also see FIG. 7) is released in the triggering process described above and one lets the trigger slide forward again after that, the ratchet of the triggering mechanism will be further rotated by a rotation unit (e.g. 60°) with the next actuation of the trigger, so there is always assurance that the left-hand (front) hammer 19 will then be triggered.

Figure 19:
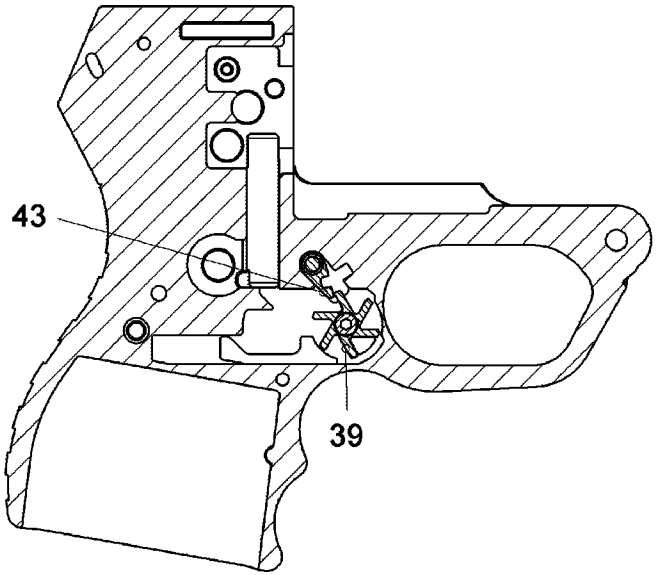
FIG. 19 shows a schematically simplified side view to explain the functions of the triggering system, wherein the view is into the left-hand grip panel of the grip piece here.
Figure 18:
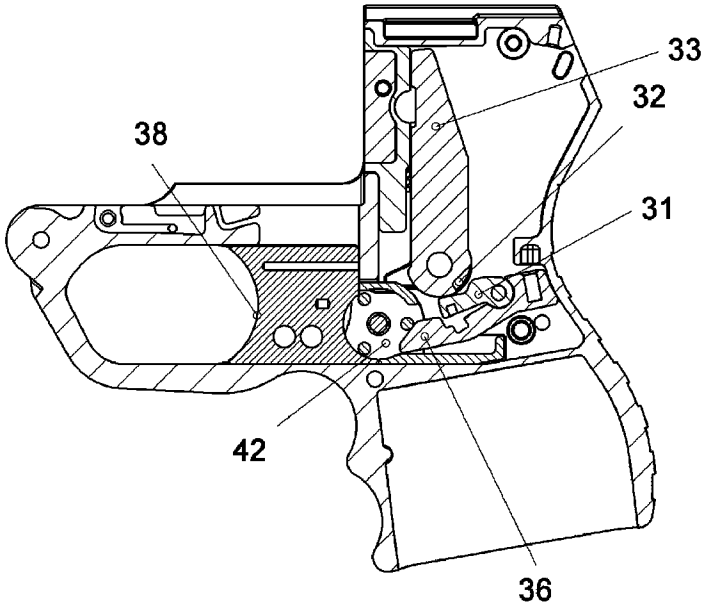
FIG. 18 shows a further schematically simplified side view to explain the functions of the triggering system in a third movement phase.

While looking into the right-hand grip panel of the grip piece in each case in FIGS. 16-18, one can look at the left-hand grip panel of the grip piece in FIG. 19 and recognize there the spring-mounted, swiveling conveyance lever 43 mounted in this grip panel as a transfer switch that interacts with the ratchet of the control wheel 39.

Figure 5:
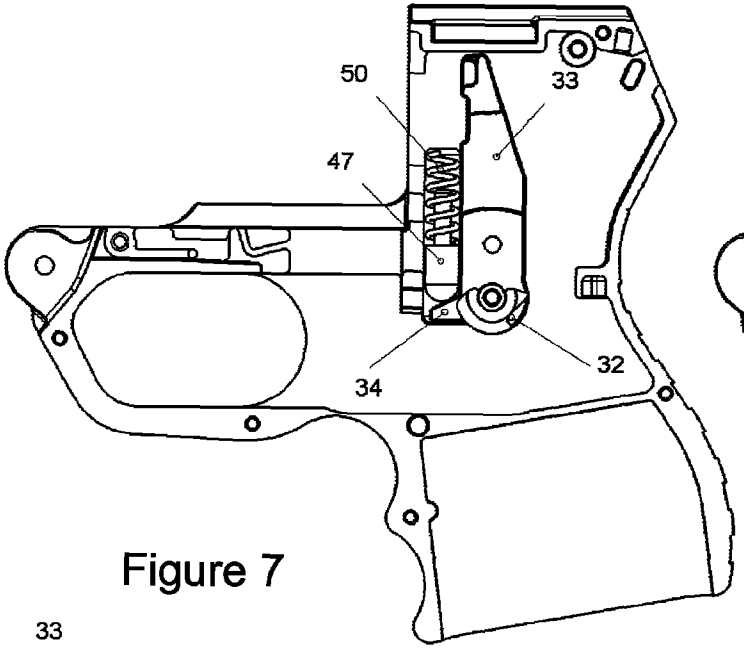
FIG. 5 shows a side view of the cocking-lever mechanism of a weapon as per the invention with a cocking lever that is not cocked.
Figure 7:
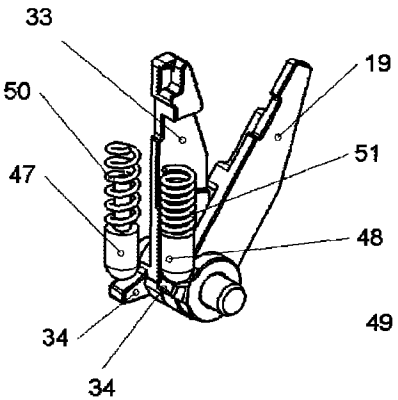
FIG. 7 shows a detailed view in perspective of a section of FIG. 5 with the two cocking levers.
Figure 21:
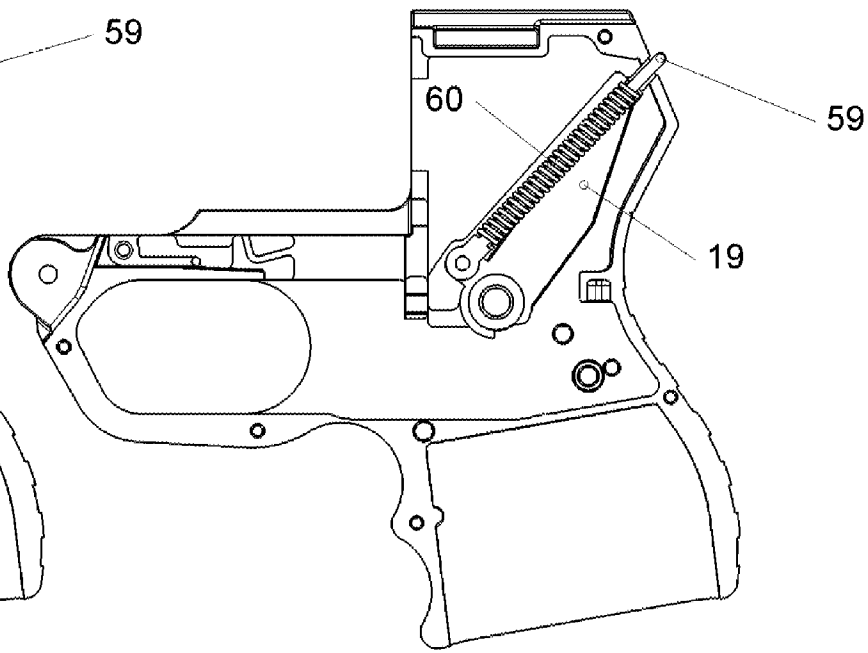
FIG. 21 shows a side view corresponding to that of FIG. 20, but the cocking lever is in the rear, cocked position.
Figure 20:
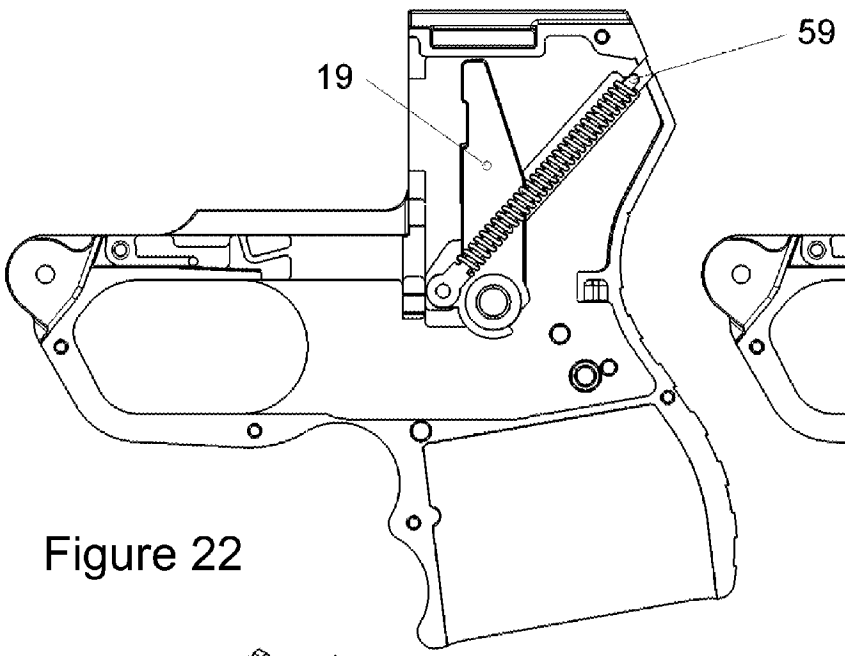
FIG. 20 shows a side view of a cocking-lever mechanism of a firearm in accordance with the invention that is an alternative to the variant of FIG. 5 with a cocking lever that is not cocked.
Figure 22:
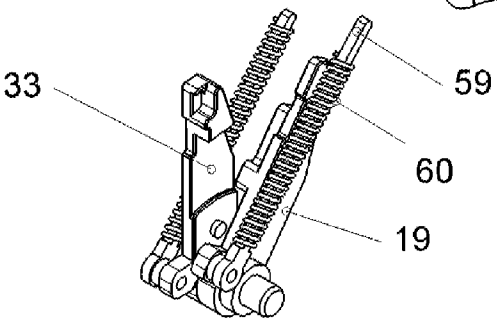
FIG. 22 shows a detailed view in perspective of a section of FIG. 20 with the two cocking levers.

A different embodiment of the spring mechanism that acts when the hammer 19 is cocked and that is an alternative to the variant of FIGS. 5 to 7 is shown in FIGS. 20 to 22. FIG. 20 shows the uncocked condition of the front hammer 19. In this variant, a strut 59 that is surrounded by a coil spring 60 is attached, e.g. riveted on, in the lower area close to the swivel axis of the hammer but at an offset to it and, in fact, in such a way that the hammer can be swiveled vis-a-vis the strut. If the hammer is now cocked starting from the position in accordance with FIG. 20, it swivels into its rear position, causing the strut 59 to move in a guided motion at a slant towards the top and rear, with the coil spring compressing in the process. In the cocked position shown in FIG. 21, the spring force of this coil spring 60 more or less acts on the hammer 19 from the top, and thus from above its swivel axis. The strut 59 and the hammer 19 are nearly parallel to one another in this cocked position. The hammer assembly is also successfully housed in a relatively small amount of space with this design, and a high amount of spring force that acts on the hammer 19 in the cocked position is nevertheless achieved in the process. At the same time, the upper end of the strut 59 turned away from the swivel point is designed in such a way that it presses outwards through an opening at the upper, rear end of the housing of the firearm in that cocked position and can thereby be used as a cocking status indicator that can be seen and felt externally at the rear of the firearm and that makes it clear which of the two hammers is cocked, as can be seen in FIG. 21. The end of the strut 59 consequently assumes a function as a cocking status indicator in this variant similar to the component 25 that has already been described with the aid of FIGS. 2 and 3. This end of the strut 59 is retracted, in contrast, and is in the housing of the firearm in the uncocked position in accordance with FIG. 20. FIG. 22 shows a view in perspective once again in which the two hammers of the hammer assembly can be seen with their respective struts 59 and tension springs; the one hammer 19 is cocked, whereas the other (right rear) hammer 33 is in the uncocked position.

Figure 24:
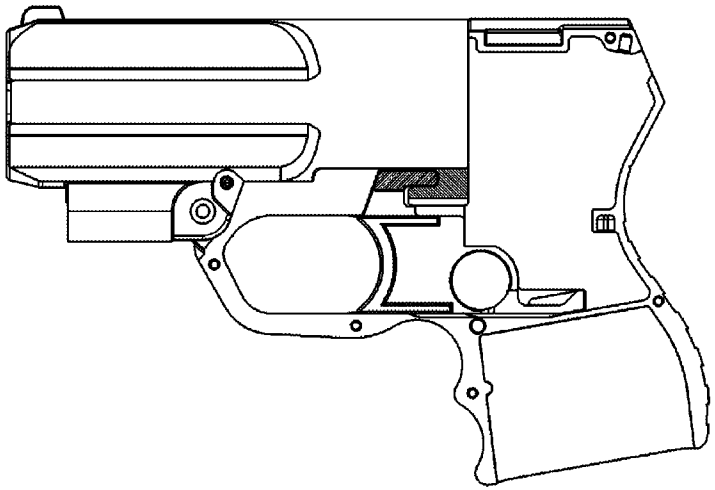
FIG. 24 shows a view corresponding to that of FIG. 23, wherein the trigger unit is in the rear position.
Figure 23:
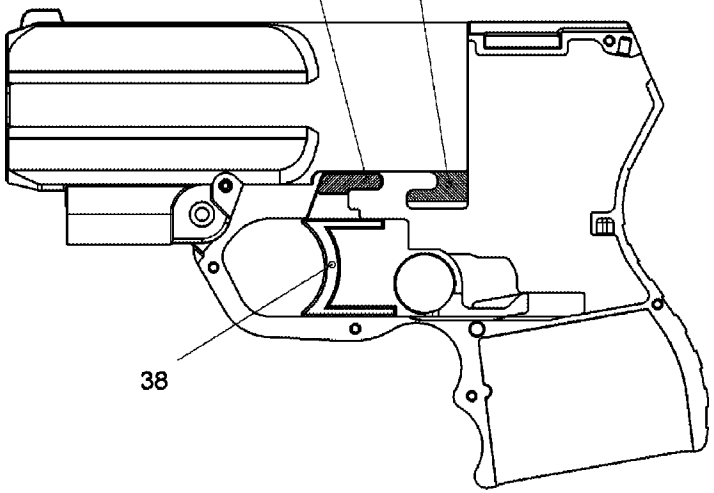
FIG. 23 shows a further side view of the firearm in which the trigger unit is in the frontal position.

As seen in FIGS. 23 and 24, there is additionally a barrel latch 23 in the firearm as per the invention. In FIG. 23, the trigger 38 is in the starting position in the front, whereas FIG. 24 shows the situation when the trigger is pulled; the trigger 38 is in its rear position. A shaped piece 23 attached to the trigger unit 37 above the trigger that serves as a barrel latch engages in a recess 24 in the lower area of the break-barrel unit 11 in this rear position. This serves to additionally fix the break barrel in place when the shot is fired.

Figure 26:
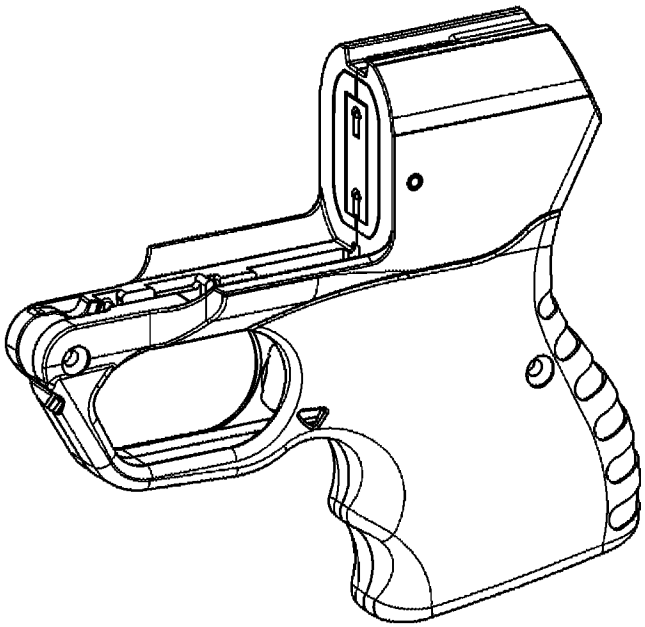
FIG. 26 shows a view in perspective corresponding to the firearm of FIG. 1 with the firing-pin unit inserted into the housing of the firearm.
Figure 25:
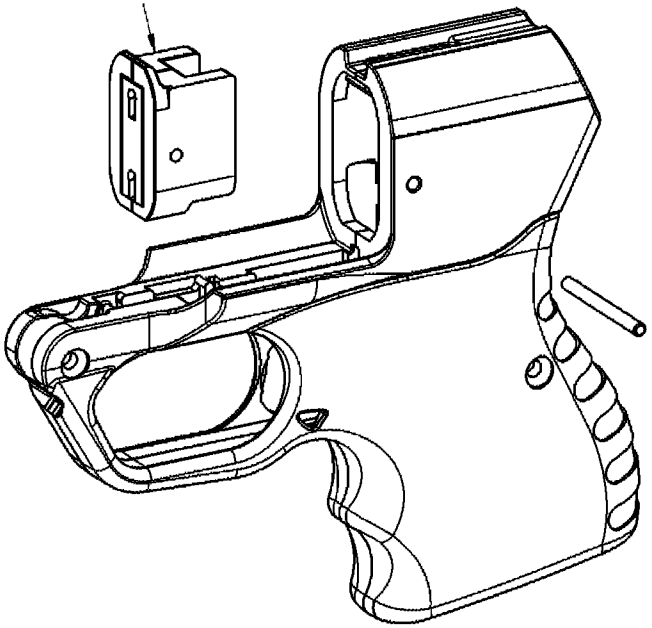
FIG. 25 shows a view in perspective of a firearm in accordance with a further exemplified variant of this invention in a partially exploded view.
Figure 27:
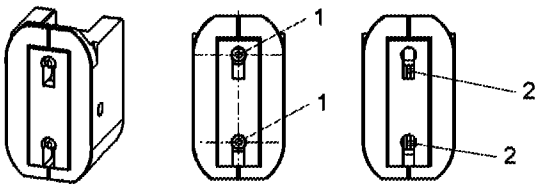
FIG. 27 shows three views of the firing-pin unit in accordance with the example of FIGS. 25 and 26, with a view in perspective on the left-hand side and a front view in each case with different firing pins in the center and on the right-hand side.

FIGS. 25 to 27 shown an alternative embodiment of this invention, which illustrates that the firing-pin unit 27 is designed to be adjustable. Reference is also made here to FIGS. 2 to 4 and the explanations above in connection with this. A possible design form of the firing-pin unit 27 can be seen in FIG. 25. This firing-pin unit 27 is, as an example, inserted from the front in an interlocking way into a correspondingly shaped holder in the upper area of the housing of the firearm. The firing-pin unit 27 is seen after insertion into the housing of the firearm in FIG. 26; it can be fixed in place in the inserted position, for instance with the pin seen in FIG. 25, which can be inserted in the crosswise direction into a hole. The left-hand side of FIG. 27 shows the firing-pin unit 27 once again in and of itself, in perspective from the front, and one sees there that this unit contains two firing pins that are arranged at the top and at the bottom and roughly on top of one another. The illustration in the center in FIG. 27 shows a firing-pin unit of that type with two firing pins for central firing ammunition; they are labeled with the reference numeral 1 in each case. The illustration on the right-hand side in FIG. 27 shows, in contrast, the same firing-pin unit, but two firing pins 2 for rim-fire ammunition have been inserted in it. It becomes clear here that the firing-pin unit is adjustable because of its modular design. The basically same component can be used as a firing-pin unit; the firing pins can be exchanged if needed. This becomes possible because, as seen in FIG. 27 in the central and right-hand illustrations, the holders in the firing-pin unit 27 for the firing pins are shaped in such a way that different types of firing pins can be accommodated. The basic shape of the firing pins 1 for central firing is more or less cylindrical, as an example, whereas the basic shape of the firing pins 2 for rim firing has a rectangular outline, for instance.

LIST OF REFERENCE NUMERALS

1 Firing pin, central firing
2 Firing pin, rim firing
10 Handgun
11 Break-barrel unit
12 First barrel
13 Second barrel
14 Grip piece
15 Slider
16 Indicator window
17 Safety lever
18 Cocking lever plate
19 Hammer (front, left)
20 Swivel axis
21 Rear end
22 Cam, projecting element
23 Barrel latch
24 Recess
25 Cocking status indicator
26 Axle
27 Firing-pin element, firing-pin unit
28 Firing pin
29 Firing pin
30 Striking surface
31 Sear
32 Projection/locking element
33 Second rear hammer
34 Radial shaped piece
35 Rocker
36 Rocker
37 Trigger unit
38 Trigger
39 Control wheel
40 Control wheel
41 Cam
42 Cam
43 Conveyance lever
44 Stud/spring guide stud
45 Spring
47 Bolt
48 Bolt
49 Swivel axis
50 Compression spring
50 Compression spring
52 Conveyance contour
53 Rear half of the housing
54 Front half of the housing
55 Oblong projection
56 Angled part
57 Tilted area
58 Ramp
59 Strut
60 Coil spring
61 Swivel axis of the hammer
70 Axle
71 Screw
72 Latching contour
73 Catch bolt
74 Spring
75 Screw

The invention claimed is:

1. Handgun comprising a weapon frame with a grip and a break-barrel unit that can be tilted forward and that is comprised of two barrels, wherein a bifunctional hammer unit is provided comprising two hammers (19, 33) that can be moved independently of one another when the firearm is triggered, wherein each hammer acts upon only one firing pin in each case of a firing-pin unit comprising at least two firing pins (28, 29) in separated positions and wherein each firing pin is assigned to one barrel (12, 13) of the firearm in each case, wherein a trigger unit (37) including a trigger (38) is provided that has an element that selectively acts on a rocker (35, 36) assigned to one of the hammers (19, 33), wherein the rocker selectively triggers one of the hammers in each case, and wherein the trigger unit (37) comprises a control-wheel unit with at least one control wheel (39, 40) that has at least two cams (41, 42) in different peripheral positions, wherein the cams alternately interact with one single rocker (35, 36) at a time in each case when the trigger is pulled several successive times and alternately trigger a hammer (19, 33) assigned to a barrel of the firearm in each case.

2. Handgun according to claim 1, wherein the bifunctional hammer unit is designed to be capable of swiveling around an axis (61) and the two hammers (19, 33) jointly swivel into their cocked position during a cocking process.

3. Handgun according to claim 2, wherein the cocking process of the hammer unit is brought about with a component that is attached to the break-barrel unit so as to be capable of swiveling via a movable cocking lever plate (18) that acts on the hammer unit when the break-barrel unit is closed.

4. Handgun according to claim 2, wherein a cocking lever plate (18) is attached in front to the break-barrel unit (11) so as to be capable of swiveling and acts on the hammer unit so that the hammer unit swivels into the cocked position when the break-barrel unit is closed.

5. Handgun according to claim 2, wherein the hammer unit has a shaped piece (34) that is radial with regard to its swivel axis (61) and that acts on a movable component (47) carried in a recess of a housing when the hammer unit swivels, wherein the component is moved against the effects of a spring force when the hammer unit is swiveled into its cocked position.

6. Handgun according to claim 5, wherein a bolt is provided as the movable component (47) that is acted upon at one end of the shaped piece (34) of the hammer unit and that acts at the other end on a compression spring (50), which is compressed in the cocked position.

7. Handgun according to claim 1, wherein a movable cocking lever plate (18) presses in an initial movement phase during the cocking of the hammer unit against a projecting element (22) of the hammer unit and swivels said hammer unit into the cocked position, and the cocking lever plate (18) moves below the projecting element (22) when the cocked position is reached and consequently releases the hammer unit.

8. Handgun according to claim 1, wherein a first firing-pin unit (27) of the firearm can be exchanged for an alternative second firing-pin unit with roughly the same dimensions in which the firing pins (28, 29) are in different positions or the firing pins have a different geometry.

9. Handgun according to claim 1, wherein the hammer unit interacts with at least one cocking status indicator (25, 59) that is partially visible on the outside of the firearm and acts on said cocking status indicator in such a way in the cocked position that said cocking status indicator is moved into a position in which said cocking status indicator indicates the cocked status of the firearm.

10. Handgun according to claim 9, wherein two movable cocking status indicators (25, 59) that are independent of one another are provided, each of which is assigned to one of the respective hammers (19, 33) and displays the cocked status of this respective hammer when said respective hammer is cocked.

11. Handgun according to claim 9, wherein at least one cocking status indicator (25) is attached in a swiveling fashion above the hammer unit and is swiveled into an upper position when the hammer (19) is cocked.

12. Handgun according to claim 1, wherein an indicator window (16) is provided on the side of the housing of the firearm that indicates the hammer that will next be actuated when the trigger is pulled.

13. Handgun according to claim 1, wherein the hammer unit has a locking element (32) by means of which the hammer unit is blocked in the cocked position by a sear (31) interacting with the locking element.

14. Handgun according to claim 1, wherein the control-wheel unit interacts with a swiveling conveyance lever (43) when the trigger unit (37) is actuated and is rotated by one rotation unit in each case.

* * * * *